US008142168B2

(12) United States Patent
Bohringer et al.

(10) Patent No.: US 8,142,168 B2
(45) Date of Patent: Mar. 27, 2012

(54) VIBRATION-DRIVEN DROPLET TRANSPORT DEVICES HAVING TEXTURED SURFACES

(75) Inventors: Karl F. Bohringer, Seattle, WA (US); Ashutosh Shastry, Cupertino, CA (US)

(73) Assignee: University of Washington, Seattle, WA (US)

( * ) Notice: Subject to any disclaimer, the term of this patent is extended or adjusted under 35 U.S.C. 154(b) by 915 days.

(21) Appl. No.: 12/179,397

(22) Filed: Jul. 24, 2008

(65) Prior Publication Data

US 2009/0211645 A1 Aug. 27, 2009

Related U.S. Application Data

(60) Provisional application No. 61/031,281, filed on Feb. 25, 2008.

(51) Int. Cl.
*F15C 1/04* (2006.01)

(52) U.S. Cl. ..... 417/53; 417/410.1

(58) Field of Classification Search ..... 417/53, 417/410.1; 137/13, 827
See application file for complete search history.

(56) References Cited

OTHER PUBLICATIONS

Shastry et al. "Micro-Structured Surface Ratchets for Droplet Transfer", Jun. 10, 2007, Transducers & Eurosensors '07, The 14th International Conference on Solid-State Sensors.*

Wixforth et al., "Acoustic Manipulation of Small Droplets", Jul. 15, 2004, Anal Bioanal Chem (2004).*

Sandre, O., et al., "Moving Droplets on Asymmetrically Structured Surfaces," Physical Review E: Statistical Physics, Plasmas, Fluids, and Related Interdisciplinary Topics 60(3):2964-2972, Sep. 1999.

Shastry, A., et al., "Directing Droplets Using Microstructured Surfaces," Langmuir 22(14):6161-6167, Jul. 2006.

Shastry, A., et al., "Engineering Surface Roughness to Manipulate Droplets in Microfluidic Systems," Proceedings of the 18th IEEE International Conference on Micro Electro Mechanical Systems (MEMS 2005), Miami Beach, Fla., Jan. 30-Feb. 3, 2005, pp. 694-697.

Shastry, A., et al., "Hydrophobic Non-Fouling Surfaces for Droplet Based Microfluidic Bioanalytical Systems," Proceedings of the 10th International Conference on Miniaturized Systems for Chemistry and Life Sciences (μTAS2006), Tokyo, Nov. 5-9, 2006, pp. 263-265.

* cited by examiner

*Primary Examiner* — Devon C Kramer

*Assistant Examiner* — Dominick L Plakkoottam

(74) *Attorney, Agent, or Firm* — Christensen O'Connor Johnson Kindness PLLC

(57) ABSTRACT

Methods and devices for moving a droplet on an elongated track on a textured surface using vibration. The elongated track on the textured surface includes a plurality of transverse arcuate projections such that a droplet on the surface is in the Fakir state and when the surface is vibrated the droplet is urged along the track as a result of an imbalance in the adhesion of a front portion of the droplet and a back portion of the droplet to the textured surface.

22 Claims, 8 Drawing Sheets

VIBRATION-DRIVEN DROPLET TRANSPORT DEVICES HAVING TEXTURED SURFACES

CROSS-REFERENCE TO RELATED APPLICATION

This application claims the benefit of U.S. Provisional Application No. 61/031,281, filed Feb. 25, 2008, expressly incorporated herein by reference in its entirety.

STATEMENT OF GOVERNMENT LICENSE RIGHTS

This invention was made with Government support under Contract/Grant No. 5ROI HG001497-09 awarded by the National Institutes of Health. The Government has certain rights in the invention.

BACKGROUND OF THE INVENTION

The promise of enabling time and space resolved chemistries has seen the emergence of droplet microfluidics for lab-on-chip technologies. Generally, prior art approaches to transporting droplets have been directed to creating global surface energy gradients by exploiting electrowetting/electrocapillarity, thermo-capillarity, chemistry, or texture. Prior art static global gradients, however, are limited in usefulness because they can only drive droplets over short distances and can never form a closed loop.

Despite recent advances in microfluidic manipulation of droplets, there remains the need for a simple method and apparatus for transporting droplets over a substrate. In particular, there is a need for an apparatus that can transport droplets along complex paths, including, for example, closed loops.

SUMMARY OF THE INVENTION

A novel approach is disclosed herein to transport droplets, wherein an engineered surface having periodic structures with local asymmetry rectifies local "shaking" into a net transport of droplets on the surface. This approach retains the simplicity and ease of operation of passive gradients while overcoming their limitations by making it possible to create arbitrarily long and complex droplet guide-tracks that can also form closed loops.

In one aspect, a method for moving a droplet along a predetermined path on a surface is provided. The method includes: providing a horizontal surface having an elongated track comprising a plurality of transverse arcuate projections that are sized and spaced to support a droplet in a Fakir state, wherein the droplet has a front portion; depositing the droplet on the elongated track; and vibrating the surface at a frequency and amplitude sufficient to cause the droplet to deform such that the front portion of the supported droplet contacts at least one additional transverse arcuate projection, thereby urging the droplet towards the additional transverse arcuate projection.

In another aspect, a device is provided for moving a droplet along a predetermined path on a surface, comprising: a surface having an elongated track comprising a plurality of transverse arcuate projections that are sized and spaced to support a droplet in a Fakir state, wherein the droplet has a front portion; and a means for vibrating the surface at a frequency and amplitude sufficient to cause the droplet to deform such that the front portion of the supported droplet contacts at least one additional transverse arcuate projection, thereby urging the droplet towards the additional transverse arcuate projection.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

The invention provides methods and devices for transporting droplets on a textured surface. A method is disclosed for transporting droplets on a surface textured with a plurality of nested transverse arcuate projections (interchangeably referred to herein as "mesas") where the motion results from vibrating a droplet having a front portion contacting a larger area of mesa surface than the back portion of the droplet, such that the imbalance of the contacted areas propels the droplet in the direction of greater contacted surface area due to surface energy minimization. The arcuate mesas form "tracks" for the moving droplet. The energetically favored movement of the droplet is in the direction of the concave portion of the arcuate mesas. Thus, as the droplets are vibrated, they "ratchet" along the arcuate mesas tracks. The tracks can be arbitrary in length and form complex shapes, including loops. While arcuate mesas are provided, it is contemplated that other mesa shapes (e.g., v-shapes) may alternatively be useful.

In one aspect, a method for moving a droplet along a predetermined path on a surface is provided. The method includes: providing a surface having an elongated track comprising a plurality of transverse arcuate projections that are sized and spaced to support a droplet in a Fakir state, wherein the droplet has a front portion; depositing the droplet on the elongated track; and vibrating the surface at a frequency and amplitude sufficient to cause the droplet to deform such that the front portion of the supported droplet contacts and adheres to at least one additional transverse arcuate projection, thereby urging the droplet towards the additional transverse arcuate projection.

In another aspect, a device is provided for moving a droplet along a predetermined path on a surface, comprising: a surface having an elongated track comprising a plurality of transverse arcuate projections that are sized and spaced to support a droplet in a Fakir state, wherein the droplet has a front portion; and a means for vibrating the surface at a frequency and amplitude sufficient to cause the droplet to deform such that the front portion of the supported droplet contacts and adheres to at least one additional transverse arcuate projection, thereby urging the droplet towards the additional transverse arcuate projection.

Figure 1:
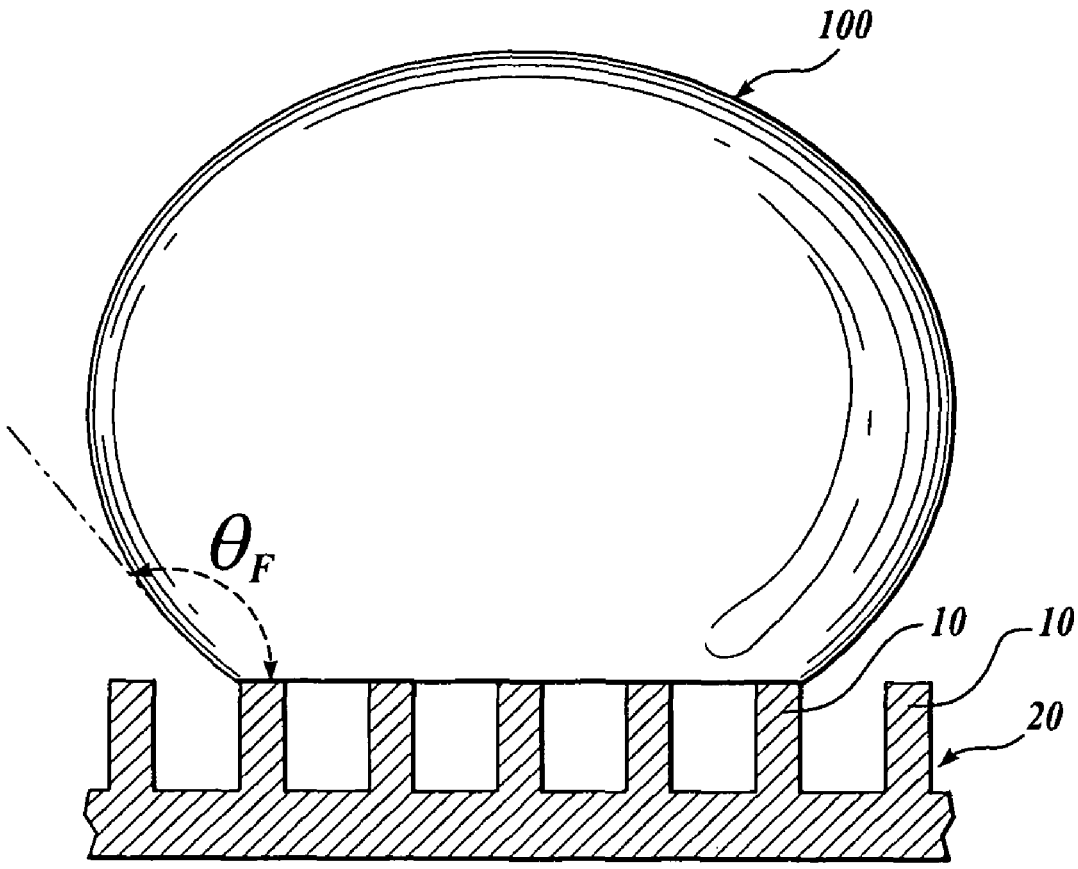
FIG. 1 is a sketch of a portion of a device in accordance with the present invention, illustrating a droplet supported in the Fakir state.

FIG. 1 shows a droplet 100 situated on a textured surfaces 20 formed in accordance with the present invention, the textured surface 20 defining a plurality of pillars 10, wherein the shape and/or the surface chemistry of the textured surface 20 and the composition of the droplet 100 allow the droplet 100 to be supported in the "Fakir" state, i.e., supported at the tops of the pillars 10. A representative droplet is a water droplet. Preferably, at least the upright or vertical portions of the pillars 10 are hydrophobic, and the pillars 10 are spaced such that the droplet 100 is supported above the pillars 10. It will be appreciated that the Fakir state is a metastable state having air pockets in the spaces between the pillars 10 below the droplet 100, and in this embodiment the surface 20 is a superhydrophobic surface. The angle $\theta_F$ represents the macroscopic contact angle between the droplet 100 and the surface 20.

Figure 2A:
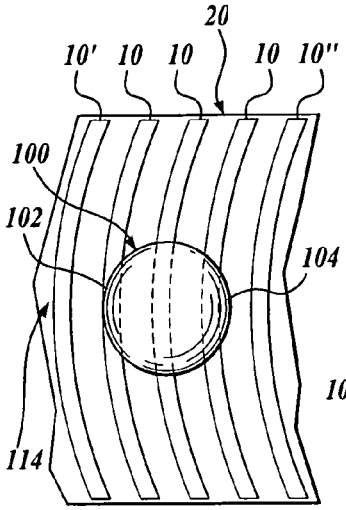
FIGS. 2A-2C are plan-view sketches of textured surfaces and droplets illustrating principles of the present invention.
Figure 2B:
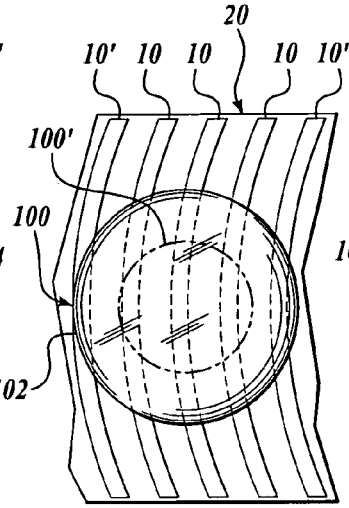
Figure 2C:
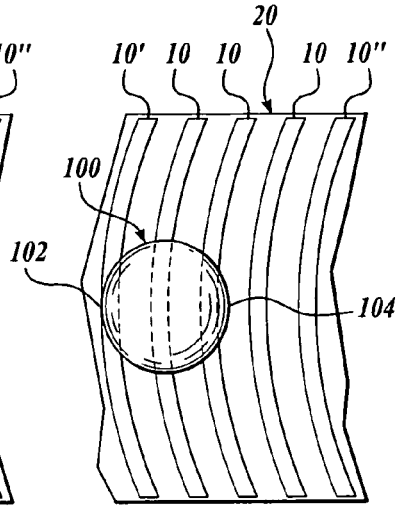
Figure 2D:
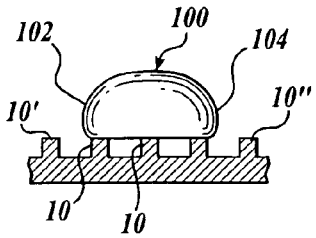
FIGS. 2D-2F are side cross-sectional sketches of the textured surfaces and droplets shown in FIGS. 2A-2C.
Figure 2E:
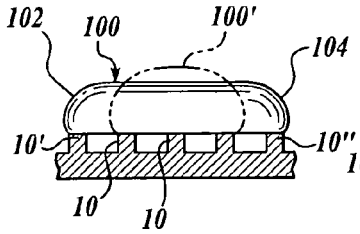
Figure 2F:
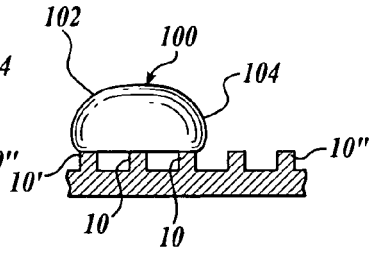

FIGS. 2A-2F show views of the textured surface 20 with the droplet 100, illustrating the basic principle of transport, which is illustrated in plan view in FIGS. 2A-2C and in side view in FIGS. 2D-2F. Referring now to FIG. 2A, in this embodiment the pillars 10 are formed as arcuate mesas comprising a track 114. Although unitary pillars 10 are illustrated, it is contemplated that each of the pillars 10 may alternatively comprise a plurality of spaced-apart posts that cooperatively define an intermittent arcuate mesa. The droplet 100 is supported on the mesas 10 with a front portion 102 of the droplet contacting a particular lead mesa 10, the lowest possible surface energy state for the droplet on the surface 20.

If the surface 20 is vibrated, inertial forces will cause the droplet 100 to deform. For example, during an upward portion of a vibration the droplet 100 will tend to spread out as the surface 20 pushes the bottom of the droplet 100 upwardly. Droplet deformation is illustrated in FIG. 2B, where the droplet 100 is flatter and covers a larger area than the original droplet footprint 100' (the deformation is exaggerated, for clarity). The actual shape of the deformed droplet 100 will depend on the intensity of the vibration and the properties of the droplet 100 and the surface 20. In FIG. 2B, the droplet front portion 102 extends and contacts the next forward mesa 10', and the back portion 104 contacts the next rearward mesa 10".

Because the arcuate shape of the mesa 10 curves in the same direction as the droplet front portion 102 (and opposite the curvature of the droplet back portion 104), the droplet front portion 102 contacts a larger surface area of mesa 10' than the back portion 104 contacts of mesa 10". Therefore, from surface energy and/or surface tension considerations, the droplet 100 will preferentially pin or adhere to mesa 10' at the front portion 102. Then, as the surface 20 vibration moves downwardly, inertial forces tend to cause the droplet 100 to elongate vertically, and the droplet 100 will move in the direction of the front portion 102. In one embodiment, the arcuate mesas define substantially circular arcs, the arcs having substantially similar radii to that of the droplet. If the radii of the arcuate mesas and the droplet are substantially similar, the amount of mesa-top surface area potentially contacted by the front portion of the droplet is maximized.

The droplet 100 moved by the above process is illustrated in FIG. 2C, where the front portion 102 of the droplet 100 now contacts the forward mesa 10'. Thus, as the surface 20 continues to vibrate, the droplet 100 will move, from right to left in FIGS. 2A-2C.

The movement of a droplet in the devices can be explained in terms of locally minimizing surface energy. The droplet front portion 102 tends to contact greater mesa surface area than the droplet back portion 104 because the front portion 102 curves in the same direction as the mesas 10. More surface area contacted results in minimized surface energy. As the surface 20 vibrates, the droplet 100 is deformed and the front portion 102 contacts greater surface area than the back portion 104 for a symmetrical deformation. The droplet 100 will therefore be urged to move towards the front portion 102. The vibration frequency and amplitude must be sufficient to cause the droplet 100 to extend across one or more of the gaps between arcuate mesas 10. So long as the front portion of the droplet continues to contact more surface area than other sides of the droplet, the front portion will be preferentially pinned to the new position and the droplet 100 will tend to move toward the front portion 102.

Figure 3:
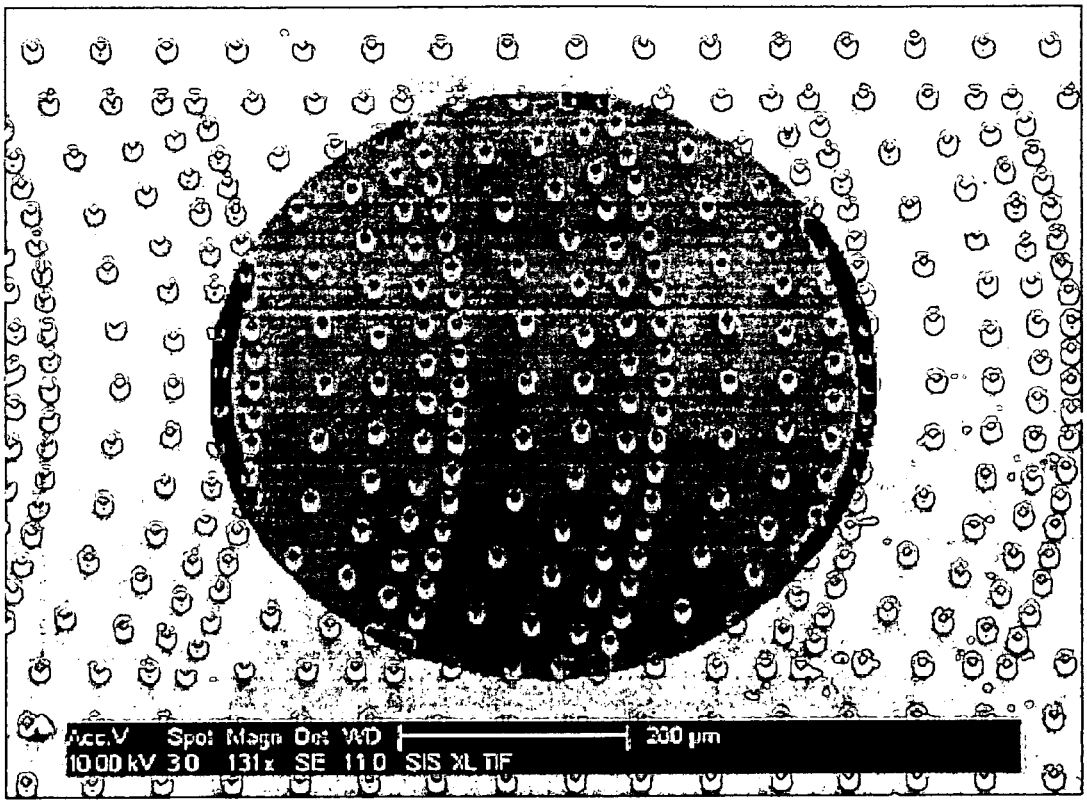
FIG. 3 is a micrograph of a textured surface in accordance with the present invention.

Referring now to FIG. 3, a micrograph of a representative textured surface is pictured. The mesas on this representative textured surface are comprised of posts positioned to define intermittent mesas in the shape of arcs and with varying density from arc to arc within a set of arcs, moving from left to right in FIG. 3. The periodic difference in arc-to-arc density is such that each arc in a set of arcs has a different linear density of posts, with the set of arcs repeating periodically.

In FIG. 3 an exemplary droplet area indicated by a dark circle (at a horizontal plane located at the top of the posts) is superimposed on the micrograph, with the darker-shaded areas of the periphery generally indicating areas of contact with the surface of the mesas. The front portion of the droplet (as illustrated, on the right-hand side of the shaded droplet area) makes contact with a larger number of posts, and thus a larger surface area, than the back portion of the droplet (on the left side of the droplet). If the exemplary substrate and droplet illustrated in FIG. 3 were vibrated, because of the energetically favorable conditions towards the right-hand side of the droplet, the droplet would move from left to right across the substrate.

Figure 4A:
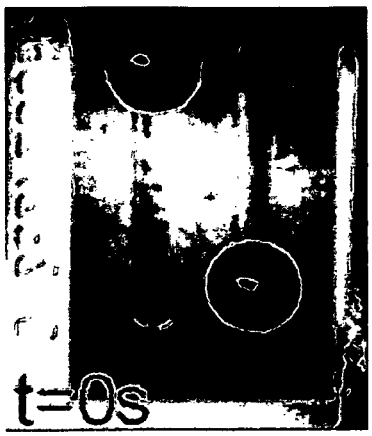
FIGS. 4A-4F are micrographs of the operation of a device in accordance with the present invention.
Figure 4B:
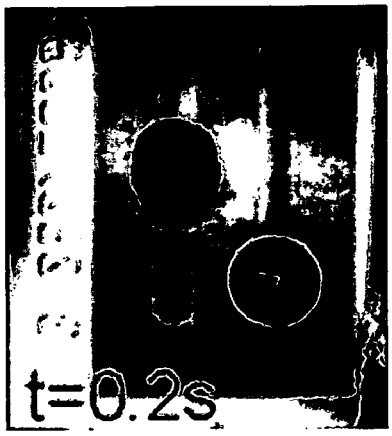
Figure 4C:
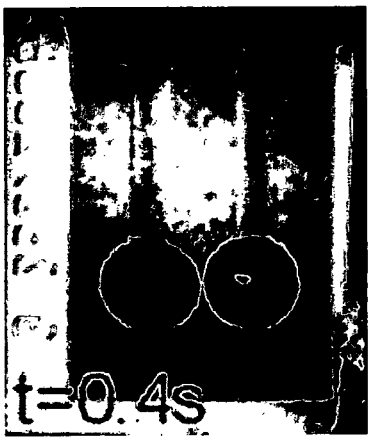
Figure 4D:
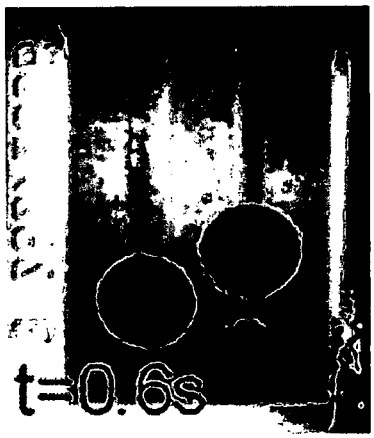
Figure 4E:
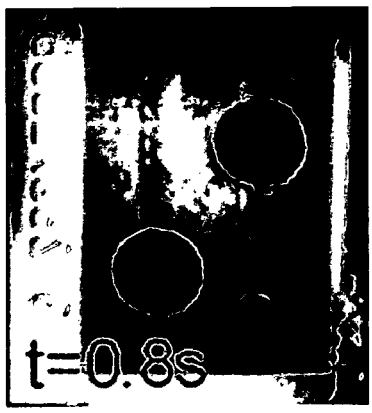
Figure 4F:
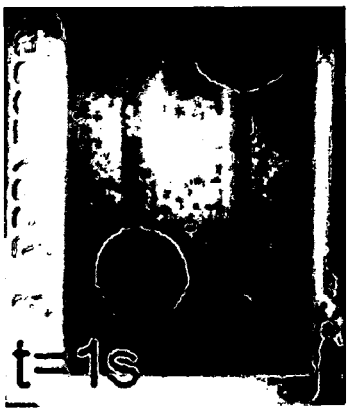

Referring now to FIGS. 4A-4F, a series of micrographs are shown that illustrate the operation of a representative device having two droplets situated upon two tracks of mesas, where the curvature of the mesas are in opposite directions (left track mesas are concave towards the top of the image, right track mesas are concave towards the bottom of the image). FIG. 4A illustrates an initial condition with both droplets at rest. As the intensity of the vibrations is increased, the smaller of the two droplets begins to move along its track, as illustrated in FIG. 4B. Maintaining a vibration intensity sufficient to move the first droplet but not the second results in the first droplet traveling to the end of its track, as illustrated in FIG. 4C. FIG. 4D illustrates the results of increasing the intensity of vibration such that the larger second droplet is induced into movement. FIG. 4E illustrates the larger droplet moving along its track and FIG. 4F illustrates the device where both droplets have moved to the end of their tracks.

Tracks useful in representative devices are not limited to linear shapes, but also include any shape that can be patterned on a surface, including looped tracks and tracks that cross.

A device need not be strictly horizontal to function, and a droplet can be transported up (or down) an incline so long as the spacing and density of the mesas and the vibration intensity are such that it is energetically favorable for a droplet to move along the incline and remain pinned at increasingly higher locations due to energy minimization. In embodiments wherein a droplet is moved along an incline, gravitational forces must be considered. For example, when driving a droplet up an incline, the pinning force at the front portion of the droplet will be resisted by gravity.

Devices can be useful, for example, in facilitating space and time-resolved chemistries, and for the handling of chemical and biological samples that are available in low quantities or low concentration.

Theory

Although not intending to be limited by the following, the inventor's current understanding of the physical mechanism included is discussed below.

Figure 5:
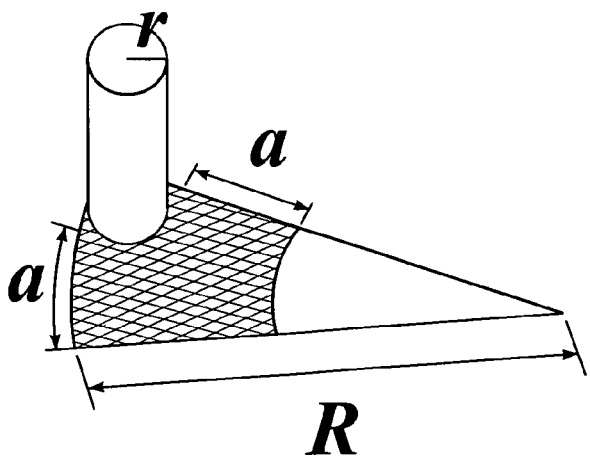
FIG. 5 is a perspective-view sketch of a mesa useful in the present invention.

As described above, representative devices operate when a droplet is in the Fakir state on a surface. The Fakir state of a droplet on a textured surface is illustrated in FIG. 1 and is the result of a particular set of surface texture parameters, as described below. A droplet on a surface has a contact angle $\theta_F$ (as illustrated in FIG. 1) when in the Fakir state as defined by Equation (1):

$$\cos\theta_F = \phi(\cos\theta_i + 1) - 1 \tag{1}$$

where $\Pi_i$ is the intrinsic contact angle of the droplet on a non-textured mesa material and $\phi$ is a surface texture parameter defined by Equation (2), wherein a, r, and R are illustrated in FIG. 5 (for circular post mesas).

$$\phi = \frac{\pi r^2}{(a+2r)^2 - \frac{(a+2r)^3}{2R}} \tag{2}$$

Generally, $\phi$ is the ratio of total mesa-top surface area to total projected surface area.

Because $\phi$ is defined both by the post dimension and the spacing between posts, if the posts all have a constant surface size (e.g., cylindrical posts having uniform diameter), then the resulting $\phi$ value will increase the closer the posts are spaced from one another. An increase in $\phi$ corresponds to a decrease in surface energy and contact angle when referring to a system where a droplet is contacting the mesa tops.

A second texture parameter z can be expressed as the ratio of the total mesa surface area (including height, length, and width) to the total surface area over which the pillar and surrounding surface cover. The texture parameters $\phi$ and z can be distinguished in that z takes into account the three-dimensional surface area of the mesas while $\phi$ only concerns the mesa-top surface area.

The texture parameters $\phi$ and z are used to design textured surfaces that support droplets in the Fakir state, which is stable only if the inequality expressed in Equation (3) holds true:

$$\cos\theta_i < \frac{\phi - 1}{z - \phi} \tag{3}$$

Thus, if a particular droplet (liquid) and surface result in a fixed intrinsic contact angle ($\theta_i$), the design of the mesas of the substrate that influence z and $\phi$ allow the structure to be tailored to either support the Fakir state or the Wenzel state (full wetting of the surface).

The intrinsic contact angle $\theta_i$ is related to the apparent contact angle $\theta_F$ of a Fakir droplet on a textured surface according to Equation (1). The contact angle $\theta_F$ for representative droplets on textured surfaces include droplets having a contact angle $\theta_F$ of 90° to 180°.

The contact angle $\theta_F$ varies with the energy of the surface area contacted by the droplet and thus is influenced by the texture parameter $\phi$. As $\phi$ increases and the area contacted by the droplet increases, the contact angle decreases as a result of the reduction of the surface energy. The opposite also holds true: as $\phi$ decreases and the area contacted by the droplet decreases the surface energy increases and the contact angle formed between the droplet and the mesas increases. In representative devices, the front portion of the droplet has a smaller contact angle than the back portion because it contacts more surface area, and thus has a lower surface energy.

A Fakir droplet on a surface does not spontaneously transition to the Wenzel state because of the presence of an energy barrier. The contact angle $\theta_F$ depends only on $\phi$ and $\theta_i$ and is independent of the coating on the sidewall. However, the energy barrier between the Fakir and Wenzel states depends on the coatings of the sidewall and is independent of the $\theta_i$ of the mesa tops (according to Equation (3)). Thus, the size and surface chemistry of both the mesa tops and sidewalls are important for devices of the invention.

As described above, during device operation the droplet moves as the result of pinning. Pinning refers to the force between a portion of the droplet and the surface it touches. An advancing droplet is a droplet that is flattened such that it is reduced in height and increased in radius (in the plane of the substrate; assuming a symmetric vibrational mode shape), and a receding droplet is the opposite: the droplet is increased in height and reduced in surface area radius. Thus, a vibrating droplet will first advance, such that the droplet is compressed and spread out, and then will recede.

There is an asymmetry in the behavior of different portions of advancing and receding droplets, which drives the movement of droplets in representative devices. The degree of pinning of a portion of a droplet is based on the texture parameter $\phi$, with a low $\phi$ resulting in: a high contact angle $\theta_F$, a low degree of pinning in the advancing direction, and a low degree of pinning in the receding direction. A high $\phi$ (i.e., larger surface area) results in: a lower contact angle $\theta_F$, low pinning when advancing, and high pinning in the receding direction. This asymmetry in receding pinning forces results in movement towards an area of high $\phi$ if there is an asymmetry in the $\phi$ parameter between front and back portions of the droplet when vibrating. Because an area of high $\phi$ has a high degree of receding pinning, the pinned portion will remain in the high $\phi$ (low surface energy) area while the low $\phi$ area will not pin the opposite portion of the droplet, and thus the droplet is allowed to move towards a higher $\phi$ area.

Representative arcuate mesa structures are surrounded by a low-$\phi$ region that serves to repel the droplets, thus tending to retain the droplets on the arcuate mesa tracks. The $\phi$ of this region is significantly smaller than that of the track, so as to contain the droplets, but the pillars are not so sparse that the droplets sag down between them. In an exemplary embodiment, the $\phi$ of this region is less than or equal to 0.04.

Vibration

Devices operate through the vibration of droplets on a textured surface. The means for supplying the vibration is not specifically important and any techniques for generating vibration known to those of skill in the art are useful. In a representative embodiment, the vibration of the droplet is vertical (perpendicular to the substrate) and acoustically induced by a speaker driven by an amplifier. Alternatively, modal exciters (Such as the Bruel & Kjaer 4808) and piezo actuators are exemplary means for providing vibration. Non-perpendicular vibration can be useful, for example, to produce asymmetric vibrations that may act (sometimes in conjunction with surface features) to produce droplet switches, for example, where tracks intersect and a droplet is directed along a selected path by the angle (relative to the substrate) of the vibration.

The frequency and intensity of vibration needed to move a droplet depends on the size of the droplet and the energy considerations related to the textured surface. In a representative, non-limiting, embodiment, a micron-sized droplet can be transported across a textured surface with a vibration frequency of from about 1 to about 100 Hz.

Devices

Figure 6A:
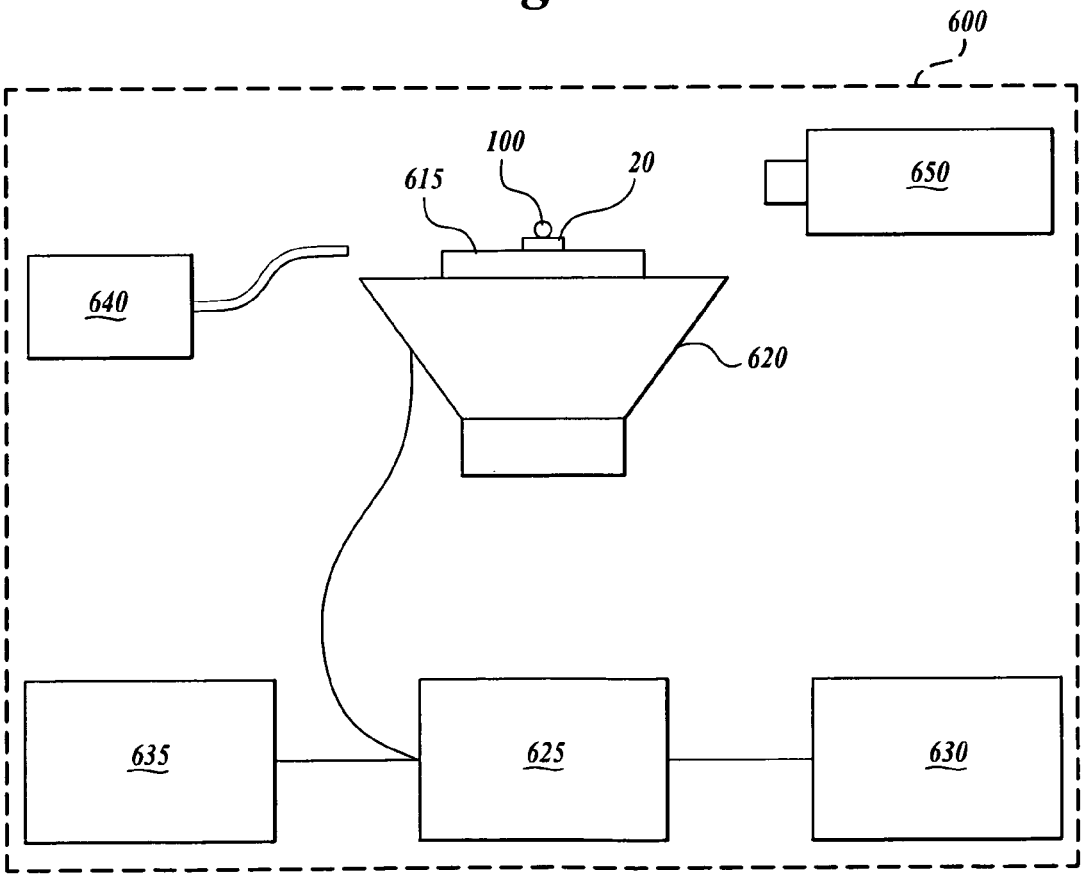
FIG. 6A is a diagram of a system for operating a device in accordance with the present invention.

An exemplary system 600 in accordance with the present invention is illustrated in FIG. 6A. The droplet 100 is disposed on the surface of the textured substrate 20, as previously described. The substrate 20 is mounted on a positionable stage 615. The stage 615 is mounted on a source for vibration 620, such as a speaker. The vibration source 620 is driven by an amplifier 625 that can also in turn be driven by a waveform generator 630 and the signal generated by the amplifier 625 can be monitored using an oscilloscope 635. The droplet 100 is recorded and contact angles are measured using a high-intensity light source 640 directed across the droplet 100 and into a high-speed camera 650. The results of a typical device of the invention operating have been previously described in conjunction with FIG. 4.

Additionally, as will be appreciated by those of skill in the art, the motion of a droplet can be measured using, for example, a laser vibrometer or a built-in accelerometer.

The devices are useful as a tool for transporting droplets to and from locations on a substrate where the droplets can be analyzed or manipulated by techniques known to those of skill in the art. Representative analytical techniques include passive analyses, such as microscopy, and destructive analyses, such as GC/MS.

Figure 6B:
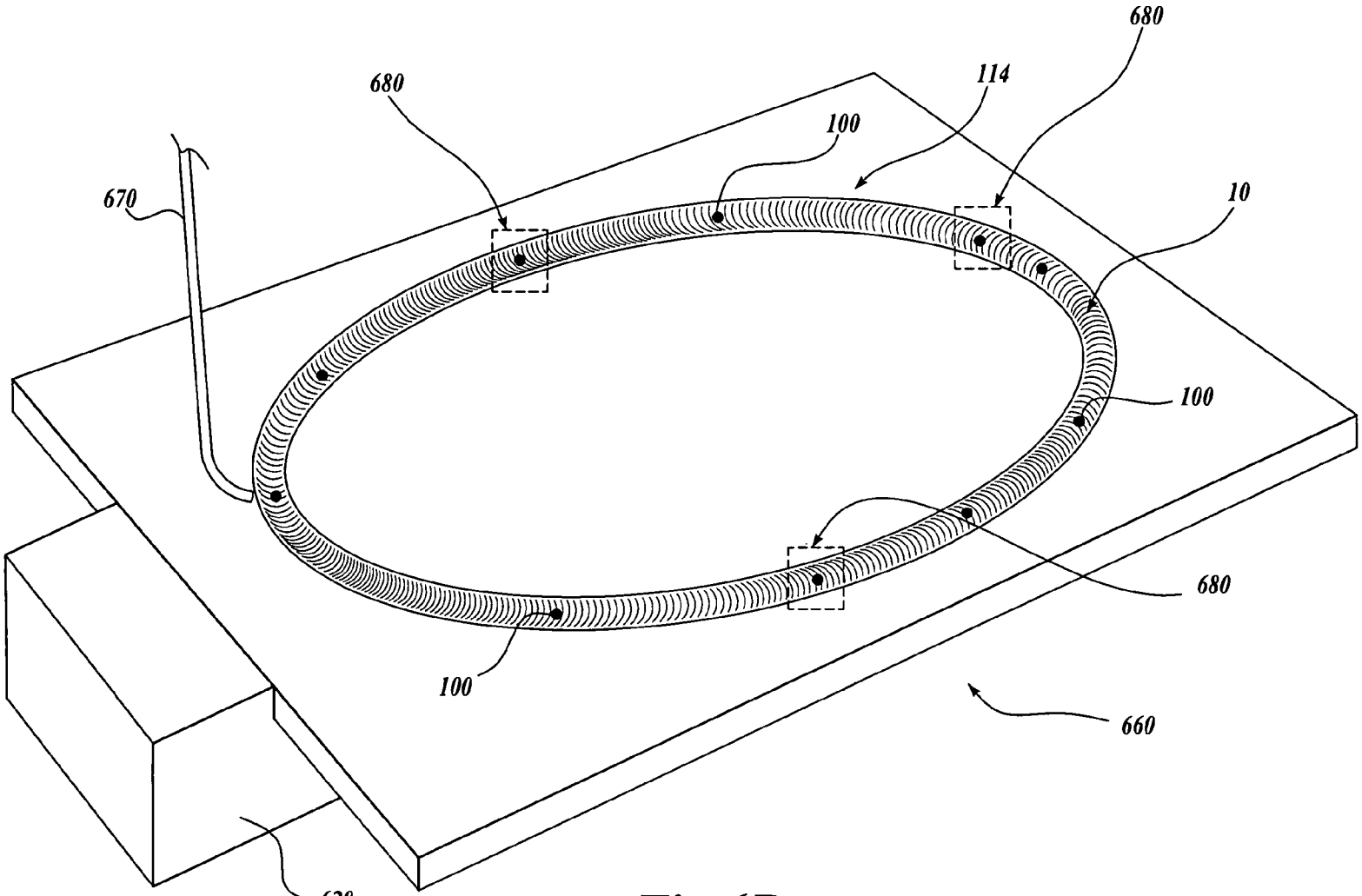
FIG. 6B is a sketch of a system for operating a device in accordance with the present invention.

An exemplary device 660 incorporating a loop-shaped track 114 of arcuate mesas 10 is sketched in FIG. 6B. Droplets 100 are supplied by a means for depositing droplets 670, which are moved along the track 114 in a counter-clockwise direction as the device 660 is vibrated by the means for vibration 620. In this exemplary device 660, the droplets 100 can be analyzed by up to three analytical techniques 680 (each of which can be the same or different from the others), such as fluorescence microscopy, as the droplet 100 moves in a loop around the track 114. By traveling in a loop, the droplet 100 can be analyzed by several analytical techniques 680. It will be appreciated that analytical techniques 680 useful in analyzing droplets 100 are known to those of skill in the art.

Textured Surface Fabrication

Textured surfaces can be fabricated using techniques known to those of skill in the art. Surfaces can be made from a range of materials (e.g., semiconductors or polymers), with the only limitation on available materials being the ability of the material to form a surface that will support a droplet in the Fakir state. Traditional semiconductor microfabrication techniques, including photolithography, thin film deposition, and etching techniques, can be used to fabricate devices of the invention, as can other techniques (e.g., molding, soft lithography, and nanoimprint lithography). Any fabrication technique is useful if it can produce the appropriate mesa structures (having the appropriate surface chemistry) for creating the Fakir state of a droplet.

Figure 7A:
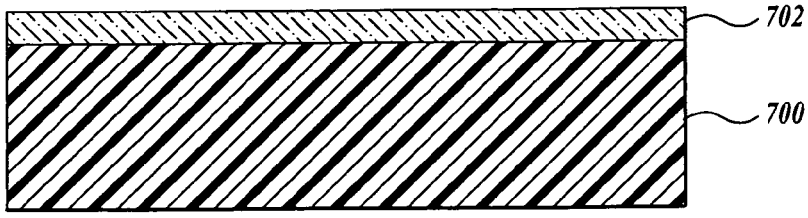
FIGS. 7A-7D illustrate the stages of the fabrication of a representative surface useful in devices in accordance with the present invention.
Figure 7B:
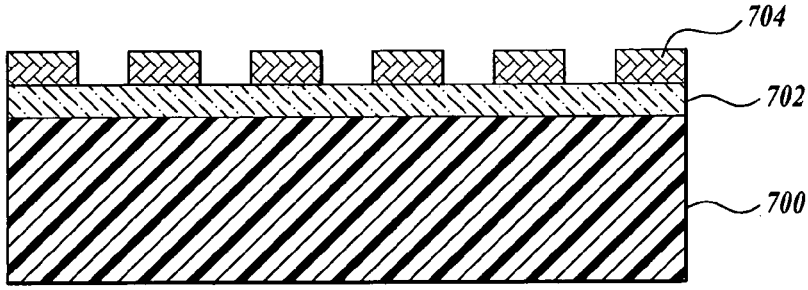

Referring now to FIGS. 7A-7D, a representative textured surface fabrication process, is illustrated using traditional microfabrication techniques. This exemplary fabrication process begins in FIG. 7A with a silicon substrate 700 having a thin oxide 702 deposited or grown on the surface. The shapes of the mesas are defined first through the use of lithography, wherein the areas that will become mesa tops are masked with photoresist 704 that is deposited and patterned on the oxide 702, as illustrated in FIG. 7B.

Figure 7C:
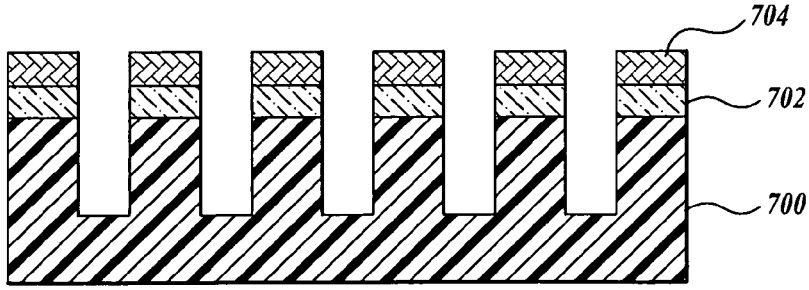
Figure 7D:
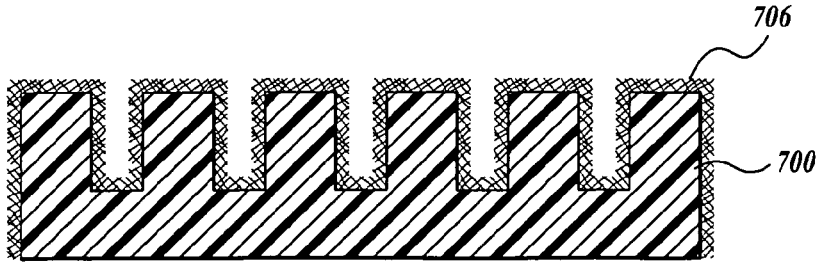

In this exemplary process, two different etching stages are performed to define the mesa height, with the resulting structure illustrated in FIG. 7C. The first etching step is a standard oxide etch (e.g., buffered oxide etch) that removes the oxide 702 that is not protected by the patterned photoresist 704. The unetched oxide 702 and the photoresist 704 both serve as etch barriers so as to mask the silicon 700 for deep reactive ion etching (DRIE) that results in the final structure illustrated in FIG. 7C. The oxide 702 and photoresist 704 are removed from the silicon 700 and a hydrophobic thin film 706 is deposited (e.g., by solution, vapor, or plasma) on the silicon 700, covering the tops, side walls, and trenches between the mesas, resulting in the structure illustrated in FIG. 7D. It will be appreciated that other techniques, such as soft lithographic processing (including micromolding and embossing) of hydrophobic polymers (e.g., PDMS), can yield similar structures as those described above; however, the mesas are then made entirely of the intrinsically hydrophobic material. Further treatment of such hydrophobic polymers can alter the hydrophobicity of portions of the structure (e.g., the tops of the mesas can be treated to become hydrophilic).

As described previously, the Fakir state is primarily a result of the hydrophobicity of the sidewalls of the mesas, although the tops of the mesas also contribute to the overall hydrophobic effects of the substrate. In one embodiment, the tops of the mesas are hydrophilic and the sidewalls of the mesas are hydrophobic.

Exemplary Device Results

An exemplary device includes round post-shaped mesas having diameters of 20 microns, the posts being shaped into arcs nested with other arcs. An exemplary structure illustrating this design is pictured in the micrograph of FIG. 3. The curvature of the rows of mesas is typically varied from 0.5 mm to 1 mm in this exemplary embodiment. The height of mesas in this exemplary embodiment is 25 microns and the droplets range in size from 5 μl to 15 μl. Droplets can be dispensed using methods known to those of skill in the art, including manually dispensing droplets with a syringe.

Figure 8:
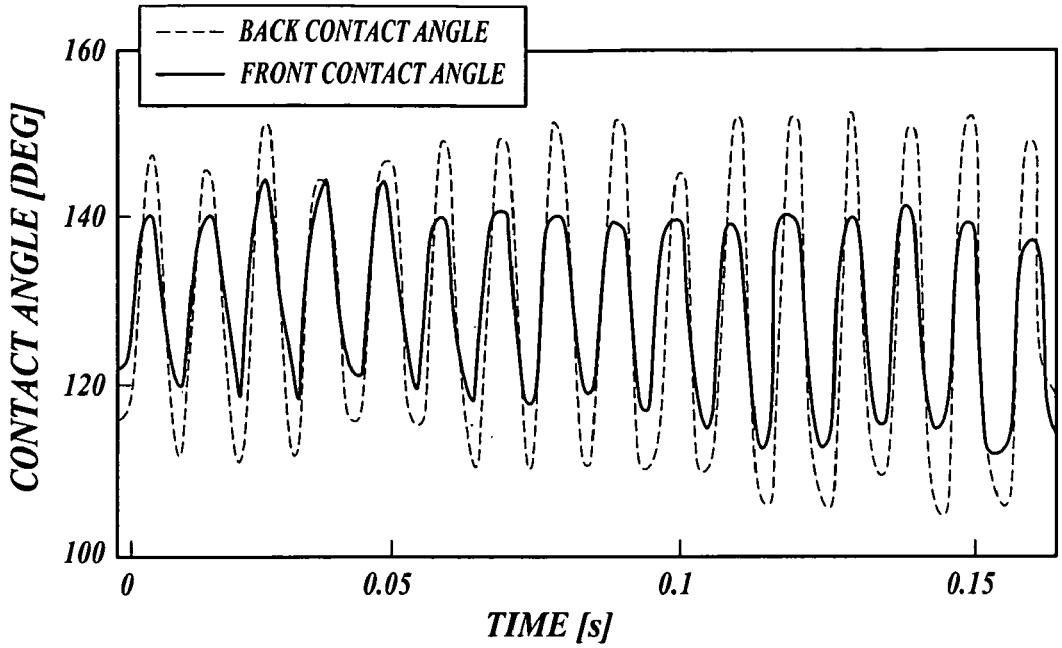
FIG. 8 is a graphical analysis of the operation of a device in accordance with the present invention.
Figure 9:
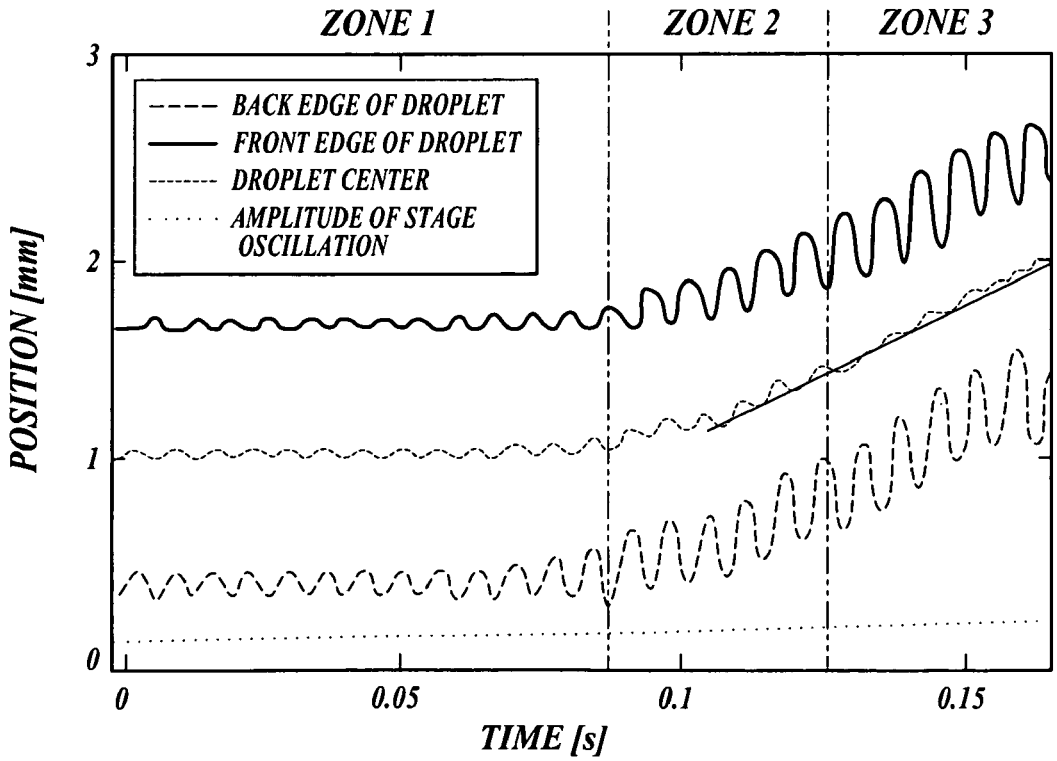
FIG. 9 is a graphical analysis of the operation of a device in accordance with the present invention.

Graphical analyses of devices of the invention are shown in FIGS. 8 and 9. FIG. 8 graphically depicts the oscillations of both the front and back portions of a vibrating droplet with respect to contact angle. In each cycle, the portions advance outward when the droplet is compressed and recede inward when the droplet is recessed. The peaks correspond to advancing angles and the troughs to receding angles. The smaller amplitude of oscillations at the front portion (the portion that is curved in the same direction as the mesas) is a direct consequence of the higher pinning that is experienced as the front portion encounters more surface area of mesas, and thus lower surface energy.

Referring now to FIG. 9, the position of a droplet is graphically depicted as the amplitude of vibration increases. With an increase in amplitude of vibration, the energy coupled into the droplet increases. In zone 1 of FIG. 9, the vibration energy is small and the droplet remains "stuck" to the surface. In zone 1, the footprint of the droplet remains constant. In zone 2, the front and back portions begin to oscillate but the energy supplied to the droplet is comparable to that dissipated in movement of the portions. Because the portions begin to oscillate, the droplet begins to translate, resulting in motion in the direction of minimized surface energy. In zone 3, the energy supplied by vibrations is high, such that the droplet begins to jump. However, the time spent when the droplet is off contact is dead time. Hence, the vibration-induced movement efficiency drops in zone 3, and movement is reduced. Thus, the advantage of high amplitudes of oscillation is reduced by the ineffective movement of droplets that are removed from the surface for a period of time as the result of strong vibrations.

In the exemplary device graphically analyzed in FIG. 9, a maximum rate of travel of a droplet vibrated on the surface is 12.5 mm/s. The terminal velocity is illustrated in FIG. 9 by the solid line drawn through the droplet-center plot. In zone 2 of FIG. 9, the droplet begins accelerating, but the acceleration peaks at 12.5 mm/s because, as vibration intensity is increased and the droplet enters zone 3, the portions of the droplet may extend further in the plane of the surface but the droplet leaving the surface for short amounts of time results in decreased efficiency of movement, and thus a terminal velocity is reached. The exemplary system used to generate the graphs of FIG. 8 and FIG. 9 includes a water droplet and a substrate as described in conjunction with FIG. 7, where the substrate comprises a silicon substrate having circular mesas etched into the surface and coated with fluorinated octyl trichlorosilane. The substrate and droplet system are vibrated in this example by a speaker driven at 49 Hz with a square wave. The droplet size is about 10 μl.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method for moving a droplet along a predetermined path on a surface, comprising:
   - providing a surface having an elongated track comprising a plurality of transverse arcuate projections that are sized and spaced to support a droplet in a Fakir state, wherein the droplet has a front portion;
   - depositing the droplet on the elongated track; and
   - vibrating the surface at a frequency and amplitude sufficient to cause the droplet to deform such that the front portion of the supported droplet contacts an at least one additional transverse arcuate projection, thereby urging the droplet towards the at least one additional transverse arcuate projection.

2. The method of claim 1, wherein the transverse arcuate projections are defined by a plurality of spaced pillars.

3. The method of claim 2, wherein the plurality of spaced pillars comprise right circular cylinders.

4. The method of claim 2, wherein the plurality of spaced pillars define a top surface and an upright surface, and further wherein at least the upright surface is hydrophobic.

5. The method of claim 4, wherein the top surface is hydrophilic.

6. The method of claim 1, wherein portions of the surface adjacent the elongated track are relatively free of surface texturing.

7. The method of claim 1, wherein at least an upright portion of the transverse arcuate projections further comprise a hydrophobic material.

8. The method of claim 1, wherein the elongated track defines a closed loop.

9. The method of claim 1, wherein the step of vibrating the surface comprises acoustically vibrating the surface.

10. The method of claim 1, wherein the transverse arcuate projections define substantially circular arcs having a predetermined radius.

11. The method of claim 10, wherein the predetermined radius is approximately equal to a radius of the droplet.

12. A device for moving a droplet along a predetermined path on a surface, comprising:
   - a surface having an elongated track comprising a plurality of transverse arcuate projections that are sized and spaced to support a droplet in a Fakir state, wherein the droplet has a front portion; and
   - a means for vibrating the surface at a frequency and amplitude sufficient to cause the droplet to deform such that the front portion of the supported droplet contacts at least one additional transverse arcuate projection, thereby urging the droplet towards the at least one additional transverse arcuate projection.

13. The device of claim 12, wherein the transverse arcuate projections are defined by a plurality of spaced pillars.

14. The device of claim 13, wherein the plurality of spaced pillars comprise right circular cylinders.

15. The device of claim 13, wherein the plurality of spaced pillars define a top surface and an upright surface, and further wherein at least the upright surface is hydrophobic.

16. The device of claim 15, wherein the top surface is hydrophilic.

17. The device of claim 12, wherein portions of the surface adjacent the elongated track are relatively free of surface texturing.

18. The device of claim 12, wherein at least an upright portion of the transverse arcuate projections further comprise a hydrophobic material.

19. The device of claim 12, wherein the elongated track defines a closed loop.

20. The device of claim 12, wherein the step of vibrating the surface comprises acoustically vibrating the surface.

21. The device of claim 12, wherein the transverse arcuate projections define substantially circular arcs having a predetermined radius.

22. The device of claim 21, wherein the predetermined radius is approximately equal to a radius of the droplet.

* * * * *